US012281539B2

(12) United States Patent
Quilico

(10) Patent No.: US 12,281,539 B2
(45) Date of Patent: Apr. 22, 2025

(54) WELLBORE PRESSURE INSENSITIVE HYDRAULIC PISTON CONFIGURATION

(71) Applicant: Schlumberger Technology Corporation, Sugar Land, TX (US)

(72) Inventor: Marco Quilico, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/260,495

(22) PCT Filed: Dec. 20, 2021

(86) PCT No.: PCT/US2021/064365
§ 371 (c)(1),
(2) Date: Jul. 6, 2023

(87) PCT Pub. No.: WO2022/154944
PCT Pub. Date: Jul. 21, 2022

(65) Prior Publication Data

US 2024/0301768 A1 Sep. 12, 2024

Related U.S. Application Data

(60) Provisional application No. 63/137,394, filed on Jan. 14, 2021.

(51) Int. Cl.
*E21B 34/08* (2006.01)

(52) U.S. Cl.
CPC ..... *E21B 34/08* (2013.01); *E21B 2200/05* (2020.05)

(58) Field of Classification Search
CPC ..... E21B 21/003; E21B 37/00; E21B 49/08; E21B 2200/05; E21B 34/08
See application file for complete search history.

(56) References Cited

U.S. PATENT DOCUMENTS 4,444,266 A 4/1984 Pringle
4,495,998 A 1/1985 Pringle
(Continued)

FOREIGN PATENT DOCUMENTS

WO 2009094308 A2 7/2009
WO 2009094309 A2 7/2009
(Continued)

OTHER PUBLICATIONS

International Search Report and Written Opinion issued in the PCT Application PCT/US2021/064365, dated Apr. 20, 2022 (12 pages).

*Primary Examiner* — Dany E Akakpo
(74) *Attorney, Agent, or Firm* — Jeffrey D. Frantz

(57) ABSTRACT

A tubing pressure insensitive and hydrostatic pressure insensitive control system includes a housing, a hydraulic piston sealingly disposed in the housing via a first seal set, and a balance piston sealingly disposed in the housing via, at least, a second seal set and a third seal set, the balance piston comprising a through-piston communication port. The housing includes a control pressure chamber associated with the hydraulic piston, and a balance pressure chamber associated with the balance piston. The system also includes a control line from the housing to surface, the control line being in fluid communication with the control pressure chamber, and a balance line from the housing to the surface, the balance line being in fluid communication with the balance pressure chamber.

16 Claims, 3 Drawing Sheets

(56) References Cited

U.S. PATENT DOCUMENTS

| | | | | |
|---|---|---|---|---|
| 4,530,377 | A * | 7/1985 | Peters | E21B 34/16 137/596.18 |
| 4,598,773 | A | 7/1986 | Pringle | |
| 4,621,695 | A | 11/1986 | Pringle | |
| 4,676,307 | A | 6/1987 | Pringle | |
| 5,251,702 | A | 10/1993 | Vazquez | |
| 5,411,096 | A | 5/1995 | Akkerman | |
| 5,415,237 | A | 5/1995 | Strattan | |
| 5,564,501 | A | 10/1996 | Strattan | |
| 5,862,864 | A | 1/1999 | Whiteford | |
| 5,906,220 | A | 5/1999 | Thompson | |
| 6,003,605 | A | 12/1999 | Dickson | |
| 6,148,920 | A | 11/2000 | McCalvin | |
| 6,173,785 | B1 | 1/2001 | Adams | |
| 6,302,210 | B1 | 10/2001 | Crow | |
| 6,427,778 | B1 | 8/2002 | Beall | |
| 6,513,594 | B1 | 2/2003 | McCalvin | |
| 6,866,101 | B2 | 3/2005 | Sloan | |
| 7,392,849 | B2 | 7/2008 | Lauderdale | |
| 7,591,317 | B2 | 9/2009 | Bane | |
| 7,624,807 | B2 | 12/2009 | Vick, Jr. | |
| 7,654,333 | B2 | 2/2010 | Smith | |
| 7,743,833 | B2 | 6/2010 | Cascario | |
| 7,766,088 | B2 | 8/2010 | Saucier et al. | |
| 7,954,550 | B2 | 6/2011 | Anderson | |
| 8,176,975 | B2 | 5/2012 | Lake et al. | |
| 8,215,402 | B2 | 7/2012 | Anderson | |
| 8,453,749 | B2 | 6/2013 | Vick, Jr. | |
| 8,616,291 | B2 | 12/2013 | Smith | |
| 9,133,687 | B2 | 9/2015 | Sloan | |
| 9,383,029 | B2 | 7/2016 | Scott | |
| 9,745,830 | B2 | 8/2017 | Lake | |
| 9,810,343 | B2 | 11/2017 | Miller et al. | |
| 10,113,392 | B2 | 10/2018 | Vick, Jr. | |
| 2002/0074129 | A1 | 6/2002 | Moore | |
| 2008/0066921 | A1 | 3/2008 | Bane | |
| 2008/0314599 | A1 | 12/2008 | Bane | |
| 2009/0250206 | A1 | 10/2009 | Lake | |
| 2012/0073829 | A1 | 3/2012 | Smith | |
| 2016/0138365 | A1 * | 5/2016 | Vick, Jr. | E21B 34/10 |
| 2019/0376366 | A1 | 12/2019 | Burris | |
| 2019/0376367 | A1 | 12/2019 | Burris | |

FOREIGN PATENT DOCUMENTS

| | | | |
|---|---|---|---|
| WO | 2019017921 | A1 | 1/2019 |
| WO | 2019040060 | A1 | 2/2019 |

* cited by examiner

WELLBORE PRESSURE INSENSITIVE HYDRAULIC PISTON CONFIGURATION

CROSS-REFERENCE TO RELATED APPLICATIONS

The present application is a national stage entry under 35 U.S.C. 371 of International Application No. PCT/US2021/064365, filed Dec. 20, 2021, which claims priority benefit of U.S. Provisional Application No. 63/137,394, filed Jan. 14, 2021, the entirety of which is incorporated by reference herein and should be considered part of this specification.

BACKGROUND

Subsurface safety valves are commonly used in wells to prevent uncontrolled fluid flow through the well in the event of an emergency, such as to prevent a well blowout. Conventional safety valves use a flapper, which is biased by a spring to a normally closed position, but is retained in an open position by the application of hydraulic fluid through a hydraulic control line from the earth's surface. As subsurface safety valves are set at greater depths, the hydrostatic pressure in the control line increases. If any seals in the safety valve malfunction while the safety valve is downhole, it is desirable that the safety valve fail in a closed position. However, higher closing forces may be required to overcome increased hydrostatic pressure at a given depth so that the safety valve may be safely closed. As such, there is a continuing need to offset the hydrostatic pressure in the control line such that the forces required to close the valve are reduced in the event that the valve fails. In addition, it is also desirable to minimize the effect of tubing pressure on the hydraulic operation of the safety valve, which will reduce the forces required to actuate the valve.

SUMMARY

A tubing pressure insensitive and hydrostatic pressure insensitive control system according to one or more embodiments of the present disclosure includes: a housing, a hydraulic piston sealingly disposed in the housing via a first seal set, and a balance piston sealingly disposed in the housing via, at least, a second seal set and a third seal set, the balance piston including a through-piston communication port. In one or more embodiments of the present disclosure, the housing includes a control pressure chamber associated with the hydraulic piston, and balance pressure chamber associated with the balance piston. The tubing pressure insensitive and hydrostatic pressure insensitive control system according to one or more embodiments of the present disclosure also includes a control line from the housing to surface, the control line being in fluid communication with the control pressure chamber; and a balance line from the housing to the surface, the balance line being in fluid communication with the balance pressure chamber.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," "left" and "right," and other like terms indicating relative positions above or below a given point or element are used in this description to more clearly describe some embodiments of the disclosure.

The present disclosure generally relates to subsurface safety valves. More specifically, one or more embodiments of the present disclosure relate to a subsurface safety valve that utilizes a two piston system including a hydraulic piston and a balance piston. In one or more embodiments of the present disclosure, hydrostatic pressure of a hydraulic system is balanced across the hydraulic piston, and the balance piston is pressure balanced to the tubing bore. As such, the only forces in play to operate the safety valve are the applied pressure acting against a power spring of the safety valve, which allows for a consistent low operating pressure that does not need to be customized to downhole well conditions.

Figure 1:
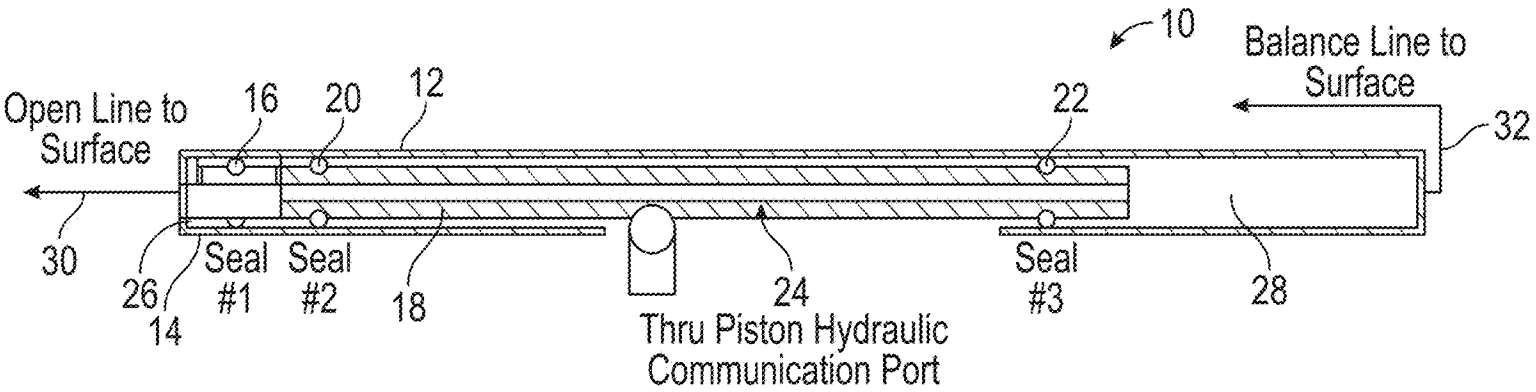
FIG. 1 shows a tubing pressure insensitive and hydrostatic pressure insensitive control system for a safety valve according to one or more embodiments of the present disclosure.
Figure 3:
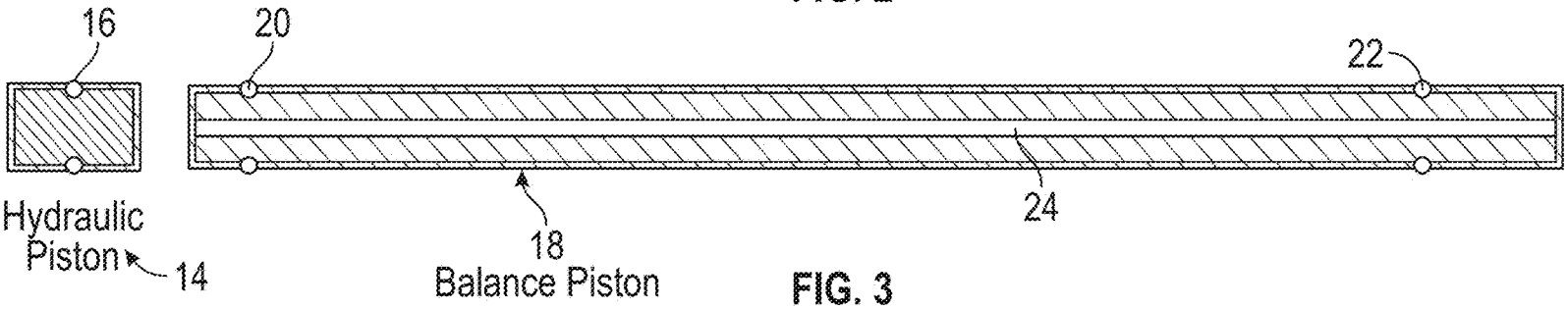
FIG. 3 shows the two pistons of the tubing pressure insensitive and hydrostatic pressure insensitive control system according to one or more embodiments of the present disclosure.

Referring now to FIG. 1, a tubing pressure insensitive and hydrostatic pressure insensitive control system 10 for a safety valve according to one or more embodiments of the present disclosure is shown. As shown in FIG. 1, the tubing pressure insensitive and hydrostatic pressure insensitive control system 10 according to one or more embodiments of the present disclosure includes a housing 12, a hydraulic piston 14, and a balance piston 18. In one or more embodiments of the present disclosure, the balance piston 18 is face fit against the hydraulic piston 14 within the housing 12, for example. For the sake of clarity, FIG. 3 shows the hydraulic piston 14 and the balance piston 18 of the tubing pressure insensitive and hydrostatic pressure insensitive control system 10 without the housing 12. Referring back to FIG. 1, the hydraulic piston 14 is sealingly disposed in the housing 12 via a first seal set 16, and the balance piston 18 is sealingly disposed in the housing 12 via second and third seal sets 20, 22. Moreover, in one or more embodiments of the present disclosure, the balance piston 18 is hollow, having a through piston hydraulic communication port 24 therethrough. For additional context, the first seal set 16 of the hydraulic piston 14, and the second and third seal sets 20, 22 and the through piston hydraulic communication port 24 of the balance piston 18 are further shown in FIG. 3, for example. According to one or more embodiments of the present disclosure, one or more of the first, second, and third seal sets 16, 20, 22 may include a bi-directional seal, for example. However, this configuration of the first, second, and/or third seal sets 16, 20, 22 is not limiting, and other seal configurations may be within the scope of the present disclosure.

Referring back to FIG. 1, the housing 12 of the tubing pressure insensitive and hydrostatic pressure insensitive control system 10 includes a control pressure chamber 26 associated with the hydraulic piston 14, and a balance pressure chamber 28 associated with the balance piston 18 and hydraulic piston 14, according to one or more embodiments of the present disclosure. As further shown in FIG. 1, the tubing pressure insensitive and hydrostatic pressure insensitive control system 10 includes an open control line 30 from the housing 12 to surface. In one or more embodiments of the present disclosure, the open control line 30 is in fluid communication with the control pressure chamber 26 of the tubing pressure insensitive and hydrostatic pressure insensitive control system 10. As also shown in FIG. 1, the tubing pressure insensitive and hydrostatic pressure insensitive control system 10 includes a balance line 32 from the housing 12 to the surface. In one or more embodiments of the present disclosure, the balance line 32 is in fluid communication with the balance pressure chamber 28 of the tubing pressure insensitive and hydrostatic pressure insensitive control system 10.

Figure 4:
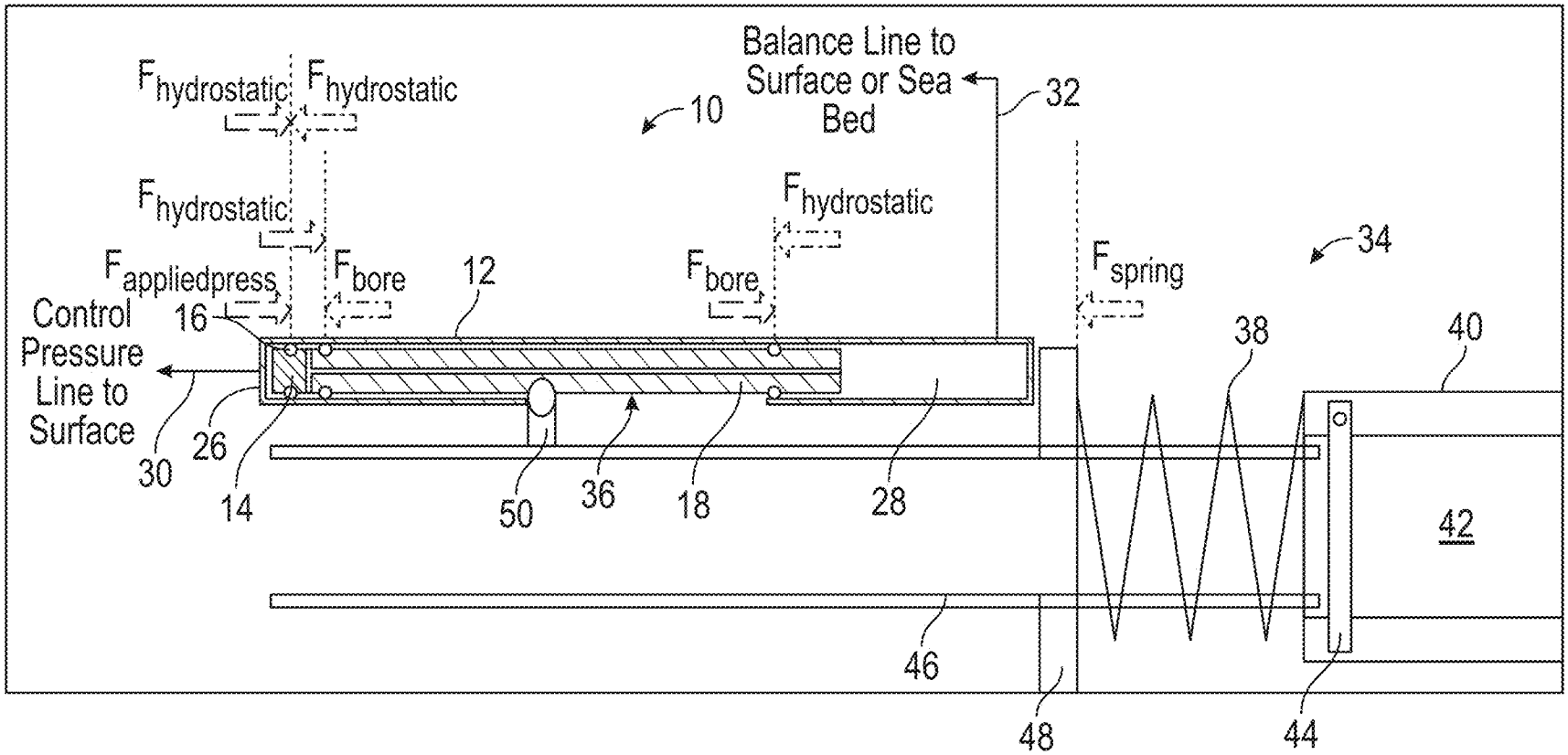
FIG. 4 shows a full safety valve free body diagram according to one or more embodiments of the present disclosure.

Referring now to FIG. 4, a full safety valve free body diagram according to one or more embodiments of the present disclosure is shown. Specifically, FIG. 4 shows the tubing pressure insensitive and hydrostatic pressure insensitive control system 10 according to one or more embodiments of the present disclosure operably connected to a safety valve 34, as further described below.

Figure 5:
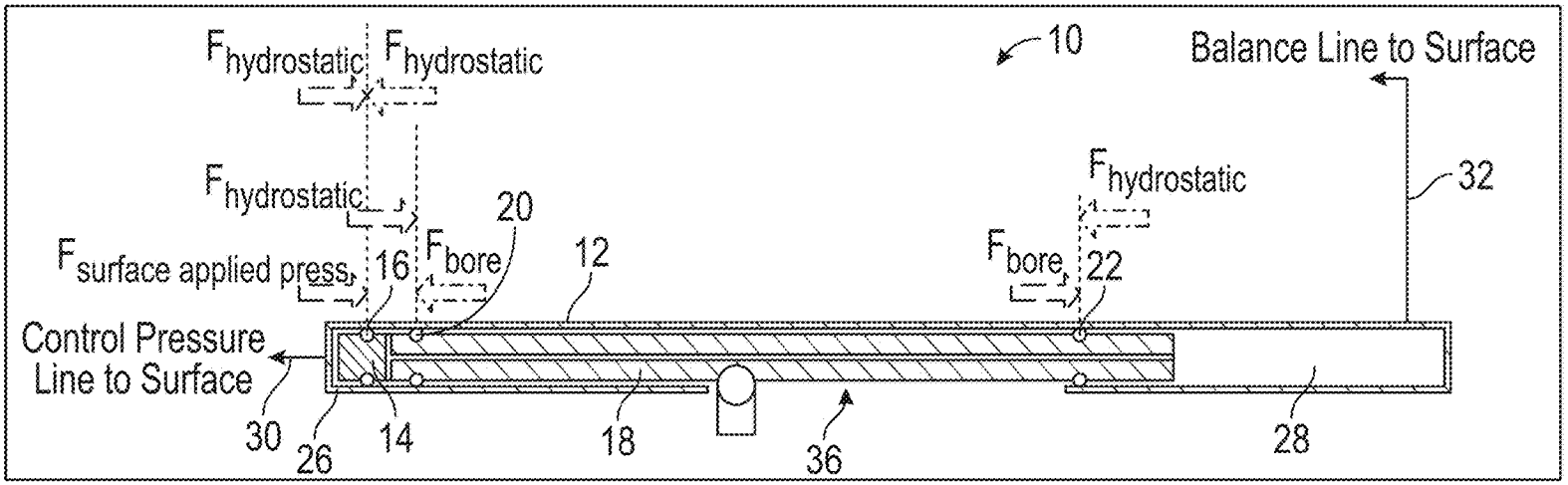
FIG. 5 shows a closer view of the piston free body diagram shown in FIG. 4 according to one or more embodiments of the present disclosure.

Referring now to FIG. 5, a closer view of the piston free body diagram of the tubing pressure insensitive and hydrostatic pressure insensitive control system 10 shown in FIG. 4 is shown. As shown in FIG. 5, the first seal set 16 of the hydraulic piston 14 holds pressure between a control line pressure of the control line 30 and a balance line pressure of the balance line 32. As shown in FIG. 5, these hydrostatic pressures across the first seal set 16 (i.e., $F_{hydrostatic}$) are substantially equal in magnitude and opposite in direction, thus completely or partially cancelling each other out, resulting in a near zero net force. Moreover, the first seal set 16 of the hydraulic piston 14 is exposed to the control pressure chamber 26 of the housing 12 in one or more embodiments of the present disclosure.

Still referring to FIG. 5, the second and third seal sets 20, 22 of the balance piston 18 hold pressure between a wellbore pressure and a balance line pressure of the balance line 32, according to one or more embodiments of the present disclosure. As shown in FIG. 5, for example, the housing 12 of the tubing pressure insensitive and hydrostatic pressure insensitive control system 10 defines an opening 36 through which the second and third seal sets 20, 22 may be exposed to wellbore pressure. As further shown in FIG. 5, wellbore pressures (i.e., $F_{bore}$) against the second seal set 20 and the third seal set 22 are equal in magnitude and opposite in direction, thus cancelling each other out. As further shown in FIG. 5, the second and third seal sets 20, 22 of the balance piston 18 are exposed to the balance pressure chamber 28. As a result, hydrostatic pressures against the second seal set 20 and the third seal set 22 (i.e., $F_{hydrostatic}$) from the balance pressure chamber 28 are equal in magnitude and opposite in direction, thus cancelling each other out.

Still referring to FIG. 5, the balance piston 18 according to one or more embodiments of the present disclosure isolates wellbore pressure from the balance pressure chamber 28 and establishes tubing pressure insensitivity. In one or more embodiments of the present disclosure, the second and third seal sets 20, 22 are disposed on the balance piston 18 in a mirrored configuration such that the seals 20, 22 are of the same size and are exposed to the same wellbore pressure and balance pressure chamber 28, but with the resulting pressure differential and the resulting force acting in opposite directions, as previously described. The resulting forces, being of equal magnitude but opposite direction cancel each other out, resulting in a zero net force.

Figure 6:
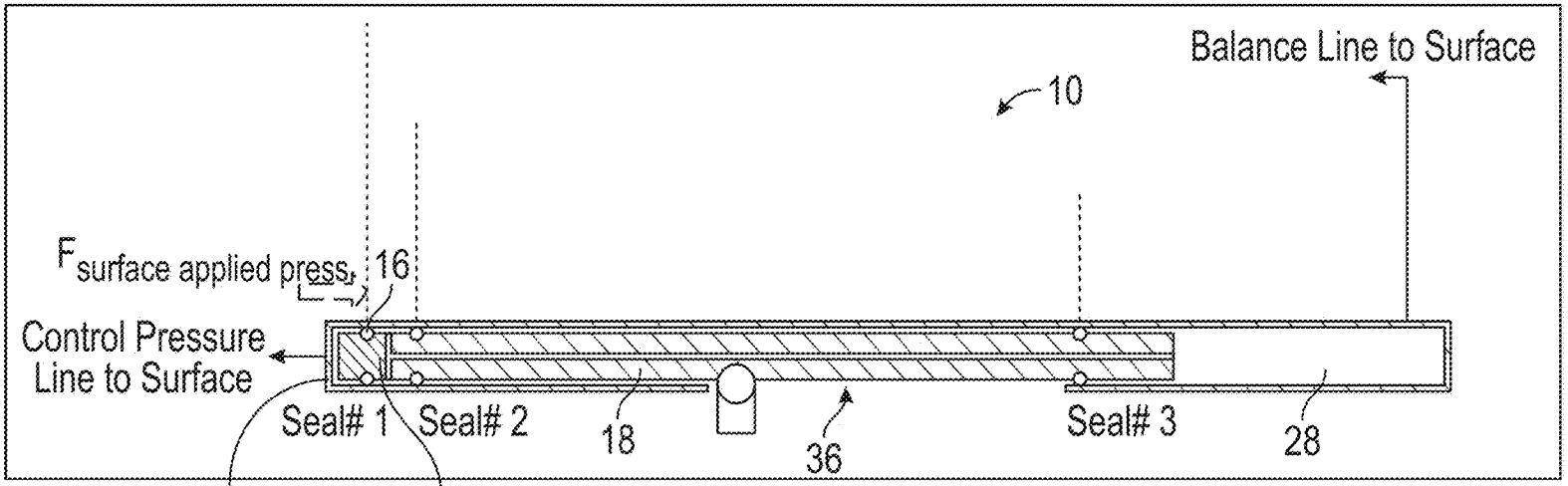
FIG. 6 shows a simplified view of the piston free body diagram shown in FIG. 5 according to one or more embodiments of the present disclosure.

Referring now to FIG. 6, a simplified view of the piston free body diagram shown in FIG. 5 is shown. Specifically, the simplified view shows the tubing pressure insensitive and hydrostatic pressure insensitive control system 10 with all forces that are equal in magnitude but opposite in direction removed. As shown in FIG. 6, the only remaining force is the control pressure applied from surface to the first seal set 16 of the hydraulic piston 14. In view of FIG. 4, as previously mentioned, an advantage of the tubing pressure insensitive and hydrostatic pressure insensitive control system 10 according to one or more embodiments of the present disclosure is that the safety valve 34 may be actuated by the control pressure in the control pressure chamber 26 overcoming the balance pressure in the balance pressure chamber 28 and a power spring force of the power spring 38 of the safety valve 34, irrespective of the wellbore pressure or setting depth. In addition to being controlled from the surface as previously described, balance pressure on the balance pressure chamber 28 may also communicate with a pressurized or atmospheric chamber located downhole and proximate to the safety valve 34 and balance piston 18, or with the tubing/casing annular fluid pressure, according to one or more embodiments of the present disclosure, for example.

Figure 2:
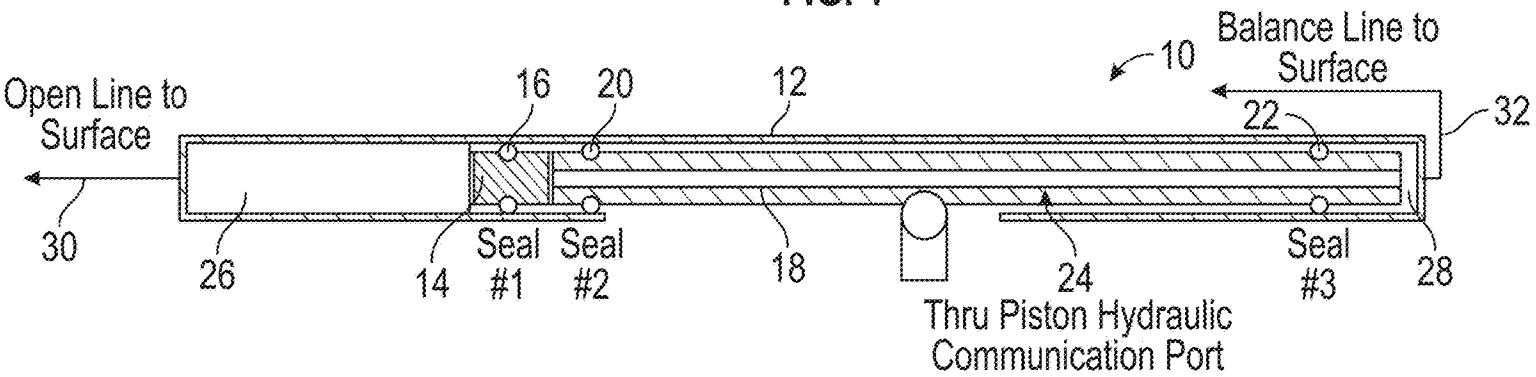
FIG. 2 shows the tubing pressure insensitive and hydrostatic pressure insensitive control system of FIG. 1 in a different operational position according to one or more embodiments of the present disclosure.

Referring now to FIGS. 2 and 4, operation of a system including the tubing pressure insensitive and hydrostatic pressure insensitive control system according to one or more embodiments of the present disclosure and an associated safety valve will now be described. In view of FIG. 4, a safety valve 34 according to one or more embodiments of the present disclosure may include a tubular member 40 having a longitudinal bore 42 therethrough, a flapper 44 pivotably mounted to the tubular member 40, a flow tube 46, and the power spring 38. In one or more embodiments of the present disclosure, the flapper 44 is movable between an open position in which the longitudinal bore 42 is unblocked, and a closed position in which the longitudinal bore 42 is blocked. The flow tube 46 is configured to move the flapper 44 between the open position and the closed position. In one or more embodiments of the present disclosure, the flow tube 46 includes a shoulder 48, and the power spring 28 is disposed around the flow tube 46 and attached to the shoulder 48. According to one or more embodiments of the present disclosure, the power spring 38 biases the flow tube 46 away from the flapper 44. As shown in FIG. 4, the housing 12 of the tubing pressure insensitive and hydrostatic pressure insensitive control system 10 defines an opening 36 through which the balance piston 18 is operably connected to the flow tube 46. In one or more embodiments of the present disclosure, the balance piston 18 may be connected to the flow tube 46 via a fastener 50 or some other type of mechanical engagement, for example.

Still referring to FIGS. 2 and 4, in operation, a method of controlling the safety valve 34 includes applying control pressure into the control pressure chamber 26 of the housing 12 of the tubing pressure insensitive and hydrostatic pressure insensitive control system 10 via the control line 30 from the surface to actuate the hydraulic piston 14. As further shown in FIG. 4, the method according to one or more embodiments of the present disclosure also includes balancing hydrostatic forces on the hydraulic piston 14 from the control line 30 with a balance line 32 to the surface. Indeed, FIG. 4 shows that hydrostatic forces (i.e., $F_{hydrostatic}$) across the first seal set 16 of the hydraulic piston 14 are opposing and substantially equal in magnitude, thus balancing and partially or completely cancelling each other out. Moreover, the method according to one or more embodiments of the present disclosure also includes using the balance piston 18 to isolate the wellbore pressure from the balance pressure chamber 28, thereby establishing tubing pressure insensitivity.

Still referring to FIGS. 2 and 4, when the control pressure applied into the control pressure chamber 26 becomes higher than the balance pressure in the balance pressure chamber 28 and higher than an opposing force of the power spring 38, a pressure differential across the first seal set 16 is established. This pressure differential results in a net force that moves the hydraulic piston 14, which moves the balance piston 18 face fit against the hydraulic piston 14, which moves the flow tube 46 of the safety valve 34 within the longitudinal bore 42, thereby moving the flapper 44 of the safety valve 34 into the open position. When the control pressure in the control pressure chamber 26 is bled to zero or below balance pressure in the balance pressure chamber 28, the flapper 44 is moved toward the closed position by the power spring 38, in one or more embodiments of the present disclosure.

As previously described, the tubing pressure insensitive and hydrostatic pressure insensitive control system 10 according to one or more embodiments of the present disclosure includes a two component piston configuration (i.e., a hydraulic piston 14 and a balance piston 18) that establishes tubing pressure insensitivity to hydraulic operation of an operably connected safety valve 34. With this two component piston configuration, the hydrostatic pressure of the hydraulic system is balanced across the hydraulic piston 14, and the balance piston 18 is pressure balanced to the tubing bore. As such, after overcoming the balance pressure, the only force in play to operate the safety valve 34 includes the applied control pressure acting against the power spring 38 of the safety valve 34. Advantageously, this allows for a consistently low operating pressure for actuating the safety valve 34 that does not need to be customized to well conditions.

Language of degree used herein, such as the terms "approximately," "about," "generally," "substantially," "near," and "proximate" represent a value, amount, or characteristic close to the stated value, amount, or characteristic that still performs a desired function or achieves a desired result. For example, the terms "approximately," "about," "generally," "substantially," "near," and "proximate" may refer to an amount that is within less than 10% of, within less than 5% of, within less than 1% of, within less than 0.1% of, and/or within less than 0.01% of the stated amount.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A tubing pressure insensitive and hydrostatic pressure insensitive control system, comprising:

a housing;

a hydraulic piston sealingly disposed in the housing via a first seal set;

a balance piston sealingly disposed in the housing via, at least, a second seal set and a third seal set, wherein the hydraulic piston and the balance piston are sequentially movable;

wherein the housing comprises a control pressure chamber associated with the hydraulic piston, and a balance pressure chamber associated with the balance piston, and wherein the balance piston comprises a through piston communication port allowing for fluid communication between the balance pressure chamber and an area in the housing between the hydraulic piston and the balance piston;

a control line from the housing to surface, the control line being in fluid communication with the control pressure chamber; and a balance line from the housing to the surface, the balance line being in fluid communication with the balance pressure chamber.

2. The tubing pressure insensitive and hydrostatic pressure insensitive control system of claim 1, wherein the first seal set holds pressure between a control line pressure of the control line and a balance line pressure of the balance line.

3. The tubing pressure insensitive and hydrostatic pressure insensitive control system of claim 1, wherein the second and third seal sets hold pressure between a wellbore pressure and a balance line pressure of the balance line.

4. The tubing pressure insensitive and hydrostatic pressure insensitive control system of claim 2, wherein the second and third seal sets hold pressure between a wellbore pressure and the balance line pressure.

5. The tubing pressure insensitive and hydrostatic pressure insensitive control system of claim 1, wherein the first seal set is exposed to the control pressure chamber.

6. The tubing pressure insensitive and hydrostatic pressure insensitive control system of claim 5, wherein the second and third seal sets are exposed to a wellbore pressure and the balance pressure chamber.

7. The tubing pressure insensitive and hydrostatic pressure insensitive control system of claim 6, wherein resulting forces on the second and third seal sets from the well bore pressure and the balance pressure chamber act in opposite directions.

8. The tubing pressure insensitive and hydrostatic pressure insensitive control system of claim 7, wherein the resulting forces are of substantially equal magnitude and partially or fully cancel each other out.

9. The tubing pressure insensitive and hydrostatic pressure insensitive control system of claim 1, wherein the balance piston isolates a well bore pressure from the balance pressure chamber and establishes tubing pressure insensitivity.

10. The tubing pressure insensitive and hydrostatic pressure insensitive control system of claim 1, wherein the balance piston is face fit or otherwise coupled with the hydraulic piston in the housing.

11. A system, comprising:

the tubing pressure insensitive and hydrostatic pressure insensitive control system of claim 1; and a safety valve, comprising:

a tubular member having a longitudinal bore therethrough;

a flapper pivotably mounted to the tubular member and movable between an open position in which the longitudinal bore is unblocked and a closed position in which the longitudinal bore is blocked;

a flow tube configured to move the flapper between the open position and the closed position, the flow tube comprising:

a shoulder; and a power spring disposed around the flow tube and attached to the shoulder, wherein the power spring biases the flow tube away from the flapper, wherein the housing of the tubing pressure insensitive and hydrostatic pressure insensitive control system defines an opening through which the balance piston is operably connected to the flow tube.

12. The system of claim 11, wherein a pressure differential between the control pressure chamber and the balance pressure chamber controls actuation of the safety valve.

13. The system of claim 11, wherein, when a pressure differential across the first seal set is higher than an opposing force of the power spring, the hydraulic piston moves the flow tube within the longitudinal bore, thereby moving the flapper into the open position, and wherein, when control pressure in the control pressure chamber is bled to zero or below balance pressure in the balance pressure chamber, the flapper is moved toward the closed position by the power spring.

14. A method of controlling a safety valve comprising a flow tube actuating a flapper; and a power spring that biases the flow tube away from the flapper, the method comprising:

applying control pressure into the control pressure chamber of the tubing pressure insensitive and hydrostatic pressure insensitive control system of claim 1 via the control line from surface to actuate the hydraulic piston;

balancing hydrostatic forces on the hydraulic piston from the control line with a balance line to the surface;

isolating well bore pressure from the balance pressure chamber and establishing tubing pressure insensitivity using the balance piston, wherein the housing of the tubing pressure insensitive and hydrostatic pressure insensitive control system defines an opening through which the balance piston is operably connected to the flow tube; and establishing a pressure differential across the first seal set in the control pressure chamber to actuate the safety valve, thereby moving the flapper into an open position.

15. The method of claim 14, further comprising:

bleeding the control pressure in the control pressure chamber to below a balance pressure in the balance pressure chamber; and moving the flapper toward a closed position by the power spring.

16. The method of claim 14, wherein the establishing step further comprises the control pressure in the control pressure chamber overcoming a balance pressure in the balance pressure chamber and a power spring force of the power spring.

* * * * *